US008105218B1

(12) United States Patent
Vayntraub

(10) Patent No.: US 8,105,218 B1
(45) Date of Patent: Jan. 31, 2012

(54) CONVEX SHELL FOR PUSH-UP HANDLE

(76) Inventor: Vladimir Vayntraub, Los Angeles, CA (US)

( * ) Notice: Subject to any disclaimer, the term of this patent is extended or adjusted under 35 U.S.C. 154(b) by 0 days.

(21) Appl. No.: 12/846,567

(22) Filed: Jul. 29, 2010

(51) Int. Cl.
*A63B 71/00* (2006.01)

(52) U.S. Cl. ..... 482/141; 482/96

(58) Field of Classification Search ..... 482/34, 482/44, 45, 46, 91, 92, 95, 96, 131, 132, 482/139, 141, 146, 148; D21/419, 662, 665, D21/684, 688, 689, 698
See application file for complete search history.

(56) References Cited

U.S. PATENT DOCUMENTS

| | | | | |
|---|---|---|---|---|
| 3,115,338 | A | 12/1963 | Acs et al. | |
| 4,610,448 | A | 9/1986 | Hill | |
| 5,358,463 | A | 10/1994 | Fuentes | |
| 6,709,371 | B2 | 3/2004 | Wu | |
| D523,493 | S | 6/2006 | Horton | |
| 7,318,793 | B2 | 1/2008 | Dubrul et al. | |
| 7,377,888 | B2 | 5/2008 | Godbold | |
| 7,585,262 | B1 * | 9/2009 | Vayntraub | 482/141 |
| D631,106 | S * | 1/2011 | Zemel | D21/662 |
| 7,909,746 | B2 * | 3/2011 | Gant | 482/141 |
| 2006/0014615 | A1 | 1/2006 | Godbold | |
| 2006/0035771 | A1 * | 2/2006 | Gant | 482/141 |
| 2006/0040809 | A1 | 2/2006 | Godbold | |
| 2007/0287605 | A1 * | 12/2007 | Mylrea et al. | 482/92 |
| 2008/0039304 | A1 * | 2/2008 | Mattox | 482/130 |
| 2010/0210430 | A1 * | 8/2010 | Mulderrig et al. | 482/141 |
| 2010/0261590 | A1 * | 10/2010 | Fares | 482/131 |
| 2010/0279833 | A1 * | 11/2010 | Gant | 482/141 |
| 2011/0071008 | A1 * | 3/2011 | Coates | 482/131 |

* cited by examiner

*Primary Examiner* — Loan Thanh
*Assistant Examiner* — Tam Nguyen
(74) *Attorney, Agent, or Firm* — QuickPatents, Inc.; Kevin Prince

(57) ABSTRACT

An improvement is disclosed for a push-up handle of the type having a cylindrical base rotatably fixed to a grip. The improvement comprises a shell having a convex outer surface and a concave inner surface, and a connector for selectively fixing the grip of the push-up handle to the shell. The shell is adapted to receive the push-up handle therein so that a peripheral portion of the base contacts the inner surface of the shell. As such, with the push-up handle resting in the shell, and with the outer surface of the shell resting on a floor surface, a user may perform push-ups such that the grip imparts rotation to the shell through the contact of the base with the shell. The outer surface contacts the floor surface at essentially a single point, resulting in little effective rotational friction between the grip and the floor surface. The shell tends to maintain a stable position on the floor, resisting tipping.

2 Claims, 2 Drawing Sheets

CONVEX SHELL FOR PUSH-UP HANDLE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to exercise devices, and more particularly to unstable push-up handles.

DISCUSSION OF RELATED ART

So-called "push-up handles" have become popular for assisting a user in keeping his arms properly positioned while doing "push-up" exercises on a floor surface. Typically such push-up handles provide a handle means for allowing the user to grasp the handle against the surface with his open palm, which puts considerably pressure on the user's wrist. Further, such prior art devices typically allow for the handle to rotate about a vertical axis.

Examples of typical prior-art push-up handles can be found in the following patents and patent applications:

| Publication No. | Issue Date | First Named Inventor |
|---|---|---|
| 3,115,338 | Dec. 24, 1963 | Acs |
| 4,610,448 | Sep. 9, 1986 | Hill |
| 5,358,463 | Oct. 25, 1994 | Fuentes |
| D523,493 | Jun. 20, 2006 | Horton |
| 7,377,888 | May 27, 2008 | Godbold |
| 2006/0146515 | Jan. 19, 2006 | Godbold |
| 2006/0040809 | Feb. 23, 2006 | Godbold |

Such prior art push-up handles suffer from the drawback that they are stable when on the floor surface, and as such the user does not have to stabilize such handles with muscles that are not otherwise exercised by such handles. As a result, using such handles prevents complete exercising of the arm, shoulder, back muscles, abs, etc.

An exercising weight disclosed in U.S. Pat. No. 6,709,371 to Wu includes a handle means with a rounded outer surface. Such a device is not well-suited to use while doing push-up exercises because the handle is significantly above the center of gravity of such a device. As such, this type of product is too unstable to be easily used by a person performing push-ups. Further, a pair of such devices is not easily transported or stored, and makes no provision for containing other exercise implements such as a jump rope, or the like. Further, such a device is weighted, which is fine for people desiring to do weight-based exercises, but is a hindrance for user's wishing to do push-up exercises.

In my previous U.S. Pat. No. 7,585,262, issued on Sep. 8, 2009, I teach a push-up device that overcomes these drawbacks. However, my prior device cannot be used with the prior art push-up handles of the type having a cylindrical base rotatably fixed to a grip. As such, people having these prior art push-up handle devices may be reluctant to abandoned such push-up handles in favor of purchasing a new device.

Therefore, there is a need for a device that can be used with such prior art push-up handles, and that still allows for natural rotation and positioning of the wrists while performing push-up exercises therewith, but that also provides a convex contact surface with the floor so that additional muscles are exercised. Such a needed device would not be so unstable as to be unusable. Further, such a needed device would be relatively inexpensive, easily transported, handled, and stored. The present invention accomplishes these objectives.

SUMMARY OF THE INVENTION

The present device is an improvement for a push-up handle of the type having a cylindrical base rotatably fixed to a grip. The improvement comprises a shell having a convex outer surface and a concave inner surface, and a connecting means for selectively fixing the grip of the push-up handle to the shell. The shell is adapted to receive the push-up handle therein so that a peripheral portion of the base contacts the inner surface of the shell.

In perhaps the simplest form, the grip may be selectively and temporarily fixed to the base with a two-part hook-and-loop type fastening strip. In such an embodiment, a first piece of one part of the fastening strip is fixed with the base, and a second piece of the one part is fixed with the grip, such that a second part of the fastening strip may be fixed across each piece to mutually and selectively secure the base rotationally to the grip. As such, with the push-up handle resting in the shell, and with the convex outer surface of the shell resting on a floor surface, a user may perform push-ups such that the grip imparts rotation to the shell through the contact of the base with the shell. As the shell is substantially rigid, the outer surface contacts the floor surface at essentially a single point, resulting in little effective rotational friction between the grip and the floor surface. The shell tends to maintain a stable position on the floor, resisting tipping.

The present invention is a device that can be used with prior art push-up handles, and that still allows for natural rotation and positioning of the wrists while performing push-up exercises therewith on a floor surface. The present invention also provides a convex contact surface with the floor so that additional muscles are exercised, but is not so unstable as to be unusable. Further, the present invention is relatively inexpensive, and easily transported, handled, and stored. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
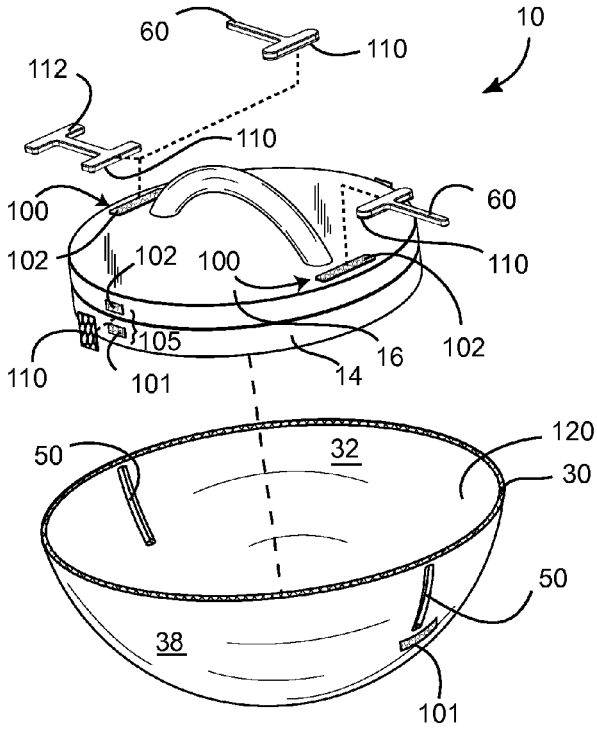
FIG. 1 is an exploded perspective view of the invention.
Figure 2:
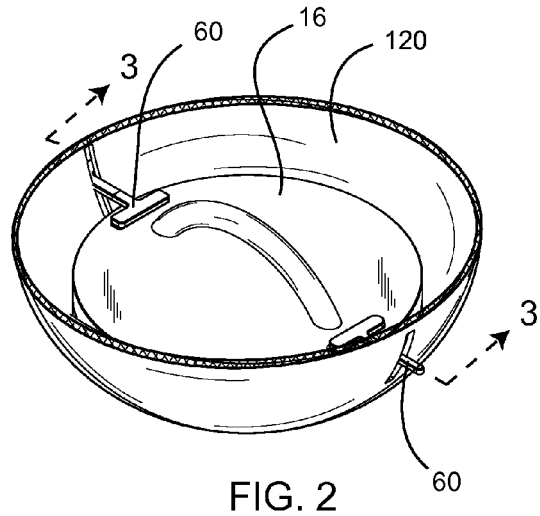
FIG. 2 is a perspective view of the invention in-use, illustrating one embodiment of a connecting means.

FIGS. 1 and 2 illustrate an improvement 10 for a push-up handle 20 of the type having a cylindrical base 14 rotatably fixed to a grip 16, such as those sold under the brand name "Perfect Pushup" by Perfect Fitness of Mill Valley, Calif., and similar products.

The improvement comprises a shell 30 having a convex outer surface 38 and a concave inner surface 32. The shell 30 is adapted to receive the push-up handle 20 therein so that a peripheral portion of the base 14 contacts the inner surface 32 of the shell 30. Preferably the shell 30 is made from a rigid plastic material formed by injection molding, rotational molding, or the like.

A high-friction surface 120 (FIG. 2), such as a rubber or other high-friction coating, may be applied to the inner surface 32 to grip the base 14. Preferably the outer surface 38 of the shell 30 is a smooth, relatively low-friction surface. The shell 30 is preferably partially spherical or ovoid in shape, from 9" to 14" in diameter, for example, such that when the cylindrical base 14 of the push-up handle 20 is placed into the shell 30, contact is made between the inner surface 32 and the cylindrical base 14 substantially entirely around the cylindrical base 14. Such a shell 30 is preferably nestable with another such shell 30 such that two shells 30 may be nested (not shown) for compact storage and travel. In one embodiment, the shell 30 is not solid, but rather is made of a framework of connectors (not shown) to conserve plastic, the partial spherical or ovoid shape being maintained.

Figure 5:
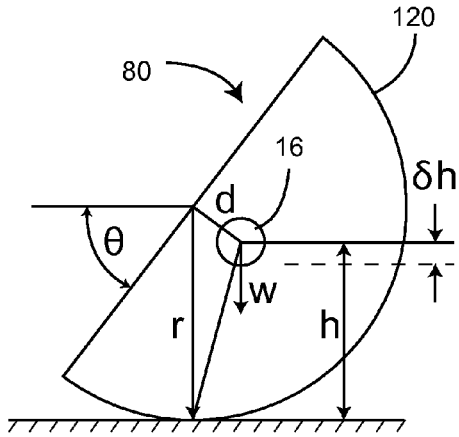
FIG. 5 is a diagram of forces imposed on the invention during use when the invention is in an unstable position.

A connecting means 40 allows selective fixing of the grip 16 of the push-up handle 20 with the inside surface 32 of the shell 30, for the purpose of preventing the grip 16 from rotating with respect to the base 14. For example, in perhaps the simplest form, the grip 16 may be selectively and temporarily fixed to the base 14 with a two-part hook-and-loop type fastening strip 100 (FIG. 1). In such an embodiment, a first piece 101 of one part 105 of the fastening strip 100 is fixed with the base 14, and a second piece 102 of the one part 105 is fixed with the grip 16, such that a second part 110 of the fastening strip 100 may be fixed across each piece 101,102 to mutually and selectively secure the base 14 rotationally to the grip 16. As such, with the push-up handle 20 resting in the shell 30, and with the convex outer surface 38 of the shell 30 resting on a floor surface 15 (FIGS. 1 and 5), a user may perform push-ups such that the grip 16 imparts rotation to the shell 30 through the contact of the base 14 with the shell 30. As the shell 30 is substantially rigid, the outer surface 38 contacts the floor surface 15 at essentially a single point, resulting in little effective rotational friction between the grip 16 and the floor surface 15.

Figure 3:
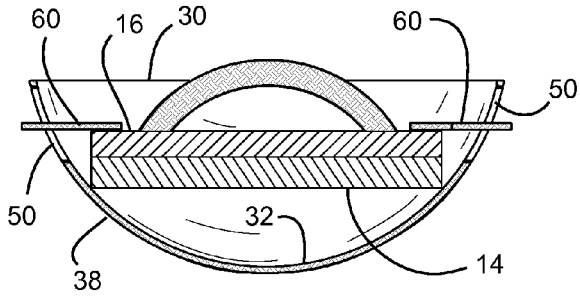
FIG. 3 is a cross-sectional view of the invention, taken generally along lines 3-3 of FIG. 2.

In an alternate embodiment, the connecting means 40 includes at least one elongated aperture 50 in the shell 30, and a rigid elongated tab 60 that is selectively attachable to the grip 16 of the push-up handle 20 (FIGS. 1-3). In FIG. 1, for ease of illustration, the rigid elongated tab 60 is shown with an alternative, mutually exclusive connecting means 40 described below. As such with the cylindrical base 14 of the push-up handle 20 resting on the inner surface 32 of the shell 30, each elongated tab 60 may project through one of the elongated apertures 50 in the shell 30 to rotationally fix the grip 16 with the shell 30.

Figure 7:
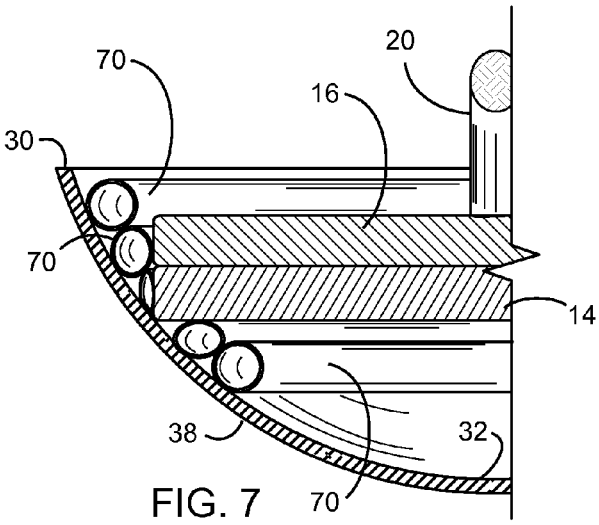
FIG. 7 is a perspective view of another alternate embodiment of the connecting means.

In another embodiment of the invention, the connecting means 40 includes a plurality of friction elements 70 (FIG. 7) fixed on the inner surface 32 of the shell 30, each friction element 70 adapted to engage the grip 16 of the push-up handle 20 and rotationally fix same with the shell 30. Such friction elements 70 may be rubber tubes 70 (as shown), resilient bristles, or the like, fixed on the inner surface 32 of the shell 30 such that when the push-up handle 20 is placed into the shell 30, at least some of the friction elements 70 contact the grip 16 of the push-up handle 20 to impart frictional securing thereof against rotation with respect to the shell 30.

Figure 6:
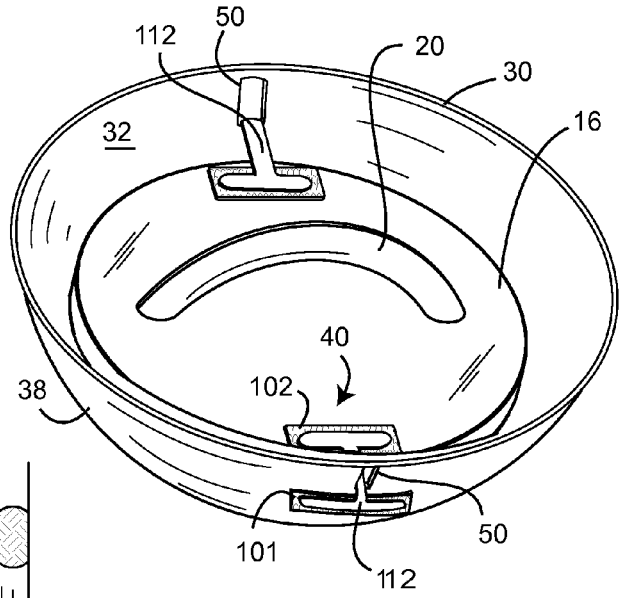
FIG. 6 is an alternate perspective view of the invention, illustrating an alternate connecting means.

In yet another alternate embodiment, illustrated in FIGS. 1 and 6, the connecting means 40 includes the at least one elongated aperture 50 in the shell 30, the first piece 101 of the one part 105 of the two-part hook-and-loop type fastening strip 100 fixed with the outer surface 38 of the shell 30, a second piece 102 of the one part 105 of the fastening strip 100 fixed with the grip 16 of the push-up handle 20, and an H-shaped piece 112 of the second part 110 of the fastening strip 100 traversing the elongated aperture between the first and second pieces 101,102 of the one part 105 of the fastening strip 100. As such, the grip 16 is rotationally fixed with the shell 30. For ease of illustration, in FIG. 1 the H-shaped piece 112 is shown as an alternate to the rigid elongated tab 60 described above, it being understood that the connecting means 40 may be either of the two but not likely both.

Figure 4:
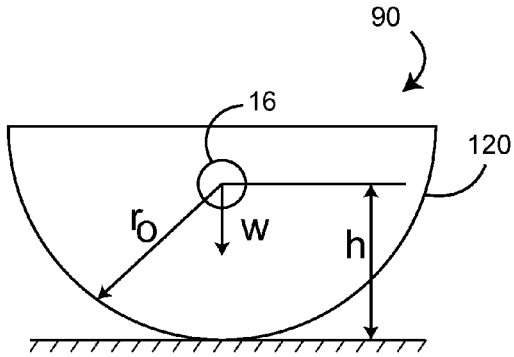
FIG. 4 is a diagram of forces imposed on the invention during use when the invention is in a stable position.

In use, with the push-up handle 20 resting within the shell 30, the shell 30 tends to maintain a stable position (FIG. 4) on a floor surface 15 since a distance $r_0$ from a center of the grip 16 to the floor surface 15 is the smallest such distance $r_0$ possible with respect to tilting of the shell 30 on the floor surface 15. For the shell 30 to be tilted by rolling on the floor surface 15 (FIG. 5), a force must be exerted which results in the raising of the grip 16 with respect to the floor surface 15 (FIG. 6), the center of the grip 16 being a distance d below a rim 35 of the shell 38. There is at this point a restoring force acting to stabilize the shell 30. This force is proportional to the weight W on the grip 16, so the more weight, the greater the restoring force. At relatively large tilt angles, the restoring force also becomes increasingly larger.

Consider a weight W on the grip 16 of the shell 30. In the case wherein the shell 30 is a half-sphere or radius r, when tilted (FIG. 5) by an angle θ, the weight is no longer over the point of stable contact with the floor 15. Therefore, there is a torque of strength of $Wd \sin(\theta)$ acting on the shell 30. When $\theta=0$, there is no torque. As θ increases the torque increases as well, urging the shell 30 back into its stable position.

While a particular form of the invention has been illustrated and described, it will be apparent that various modifications can be made without departing from the spirit and scope of the invention. For example, various connecting means 40 may be utilized that rotationally fix the grip 16 of the push-up handle 20 with the shell 30. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An improvement for a push-up handle of the type having a cylindrical base rotatably fixed to a grip, the improvement comprising:

a shell having a convex outer surface and a concave inner surface; and a connecting means selectively fixing the grip of the push-up handle to the concave inner surface of the shell, the connecting means including at least one elongated aperture in the shell, and at least one rigid elongated tab selectively attachable to the grip of the push-up handle such that with the cylindrical base of the push-up handle resting on the concave inner surface of the shell, the at least one elongated tab projects through the at least one elongated aperture in the shell to rotationally fix the grip with the shell.

2. An improvement for a push-up handle of the type having a cylindrical base rotatably fixed to a grip, the improvement comprising:

a shell having a convex outer surface and a concave inner surface; and a connecting means selectively fixing the grip of the push-up handle to the concave inner surface of the shell, the connecting means including at least one elongated aperture in the shell, a first piece of one part of a two-part hook-and-loop type fastening strip fixed with the outer surface of the shell, a second piece of the one part of the two-part hook-and-loop type fastening strip fixed with the grip of the push-up handle, and a second part of the two-part hook-and-loop type fastening strip traversing through the elongated aperture between the first and second pieces of the one part of the two-part hook-and-loopy type fastening strip to selectively fix itself to the first and second pieces of the one part of the two part hook and loop type fastening strip, thereby rotationally fixing the grip with the shell.

* * * * *